US008632243B2

(12) United States Patent
Leung

(10) Patent No.: US 8,632,243 B2
(45) Date of Patent: Jan. 21, 2014

(54) MICROFLUIDIC MIXING USING CONTINUOUS ACCELERATION/DECELERATION METHODOLOGY

(75) Inventor: Wallace Woon-Fong Leung, Kowloon (CN)

(73) Assignee: The Hong Kong Polytechnic University, Hung Hom, Kowloon (HK)

( * ) Notice: Subject to any disclaimer, the term of this patent is extended or adjusted under 35 U.S.C. 154(b) by 1323 days.

(21) Appl. No.: 12/073,722

(22) Filed: Mar. 10, 2008

(65) Prior Publication Data

US 2009/0225625 A1 Sep. 10, 2009

(51) Int. Cl.
*B01F 9/02* (2006.01)

(52) U.S. Cl.
USPC ..... 366/211; 366/213; 366/217; 366/220

(58) Field of Classification Search
USPC ..... 366/142, 348, 210, 211, 213, 214, 216, 366/217, 220, DIG. 4; 422/72, 503, 506, 422/548; 435/286.7
See application file for complete search history.

(56) References Cited

U.S. PATENT DOCUMENTS

| | | | | | |
|---|---|---|---|---|---|
| 3,770,250 | A * | 11/1973 | Uchida | 366/297 |
| 4,628,391 | A * | 12/1986 | Nyman et al. | 366/265 |
| 4,849,182 | A * | 7/1989 | Luetzelschwab | 422/134 |
| 4,938,606 | A * | 7/1990 | Kunz | 366/134 |
| 5,525,240 | A * | 6/1996 | Lemelson | 210/745 |
| 5,622,650 | A * | 4/1997 | Rourke | 516/9 |
| 5,632,596 | A * | 5/1997 | Ross | 415/83 |
| 6,063,589 | A * | 5/2000 | Kellogg et al. | 435/24 |
| 6,527,432 | B2 * | 3/2003 | Kellogg et al. | 366/182.1 |
| 6,613,580 | B1 * | 9/2003 | Chow et al. | 436/180 |
| 6,714,299 | B2 | 3/2004 | Peterson et al. | |
| 6,858,185 | B1 * | 2/2005 | Kopf-Sill et al. | 422/504 |
| 6,995,845 | B2 * | 2/2006 | Worthington | 356/436 |
| 7,026,131 | B2 * | 4/2006 | Hurt et al. | 435/7.25 |
| 7,061,594 | B2 * | 6/2006 | Worthington et al. | 356/72 |
| 7,064,827 | B2 | 6/2006 | Nurmikko et al. | |
| 7,087,203 | B2 * | 8/2006 | Gordon et al. | 422/72 |
| 7,141,416 | B2 * | 11/2006 | Krutzik | 435/288.5 |
| 7,200,088 | B2 * | 4/2007 | Worthington et al. | 369/53.31 |
| 7,221,632 | B2 * | 5/2007 | Worthington | 369/53.2 |
| 7,242,474 | B2 | 7/2007 | Cox et al. | |
| 7,261,859 | B2 | 8/2007 | Andersson et al. | |
| 7,298,478 | B2 | 11/2007 | Gilbert et al. | |
| 7,390,464 | B2 * | 6/2008 | Kido et al. | 422/547 |
| 7,476,361 | B2 * | 1/2009 | Kellogg et al. | 422/72 |
| 2002/0097632 | A1 * | 7/2002 | Kellogg et al. | 366/220 |
| 2003/0064507 | A1 * | 4/2003 | Gallagher et al. | 435/287.2 |
| 2003/0152491 | A1 * | 8/2003 | Kellogg et al. | 422/99 |
| 2004/0048299 | A1 * | 3/2004 | Parce et al. | 435/6 |
| 2004/0096960 | A1 * | 5/2004 | Mehta et al. | 435/287.2 |
| 2004/0126254 | A1 * | 7/2004 | Chen et al. | 417/423.1 |
| 2006/0034149 | A1 * | 2/2006 | Koeneman | 366/273 |
| 2007/0059156 | A1 * | 3/2007 | Blanchard et al. | 415/90 |
| 2008/0056063 | A1 * | 3/2008 | Cho et al. | 366/228 |
| 2008/0292502 | A1 * | 11/2008 | Kitawaki et al. | 422/72 |
| 2008/0317634 | A1 * | 12/2008 | Kido et al. | 422/72 |
| 2009/0191643 | A1 * | 7/2009 | Boehm et al. | 436/164 |
| 2009/0227041 | A1 * | 9/2009 | Wang et al. | 436/180 |
| 2009/0311737 | A1 * | 12/2009 | Locascio et al. | 435/29 |

* cited by examiner

*Primary Examiner* — Yogendra Gupta
*Assistant Examiner* — Emmanuel S Luk
(74) *Attorney, Agent, or Firm* — The Hong Kong Polytechnic University

(57) ABSTRACT

The present invention relates to a method for microfluidic mixing in a "lab-on-a-chip" environment. The methodology focuses on constant acceleration and deceleration about a mean angular speed with a rotating disk serving as the mixing platform. The methodology results in good mixing between different fluids.

15 Claims, 4 Drawing Sheets

MICROFLUIDIC MIXING USING CONTINUOUS ACCELERATION/DECELERATION METHODOLOGY

BACKGROUND

Microfluidics refers to the design and use of fluid systems in which at least one dimension is smaller than 1 mm. Fluid flow in microfluids systems can be characterized as either laminar or turbulent. Turbulent flow is chaotic on a small scale, such as tap water turned on at full blast. Laminar flow consists of fluid flowing in layers in which the velocity at a given time and place is invariant under steady-state conditions. Due to the small size of microfluidic systems, laminar flow predominates. A key aspect that contributes to both the advantages and disadvantages of laminar flow is the absence of convective transport between adjacent layers of fluid. This lack of convection poses clear problems in terms of successful on-chip mixing, after leading to non-diffuse or poorly mixed solutions.

It is an object of the present invention to overcome the disadvantages and problems in the prior art.

DESCRIPTION

The present invention relates to a method for microfluidic mixing in a "lab-on-a-chip" environment. The methodology focuses on continuous acceleration and deceleration about a mean angular speed with a rotating platform serving as the mixing platform. The methodology results in good mixing between different species. The rotating platform can be read by an optical analyzer that may be stationery or portable.

These and other features, aspects, and advantages of the apparatus and methods of the present invention will become better understood from the following description, appended claims, and accompanying drawings where:

Figure 4:
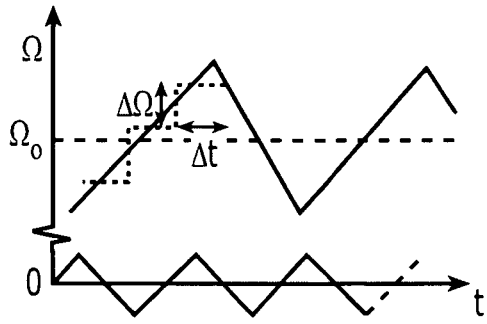
Figure 5:
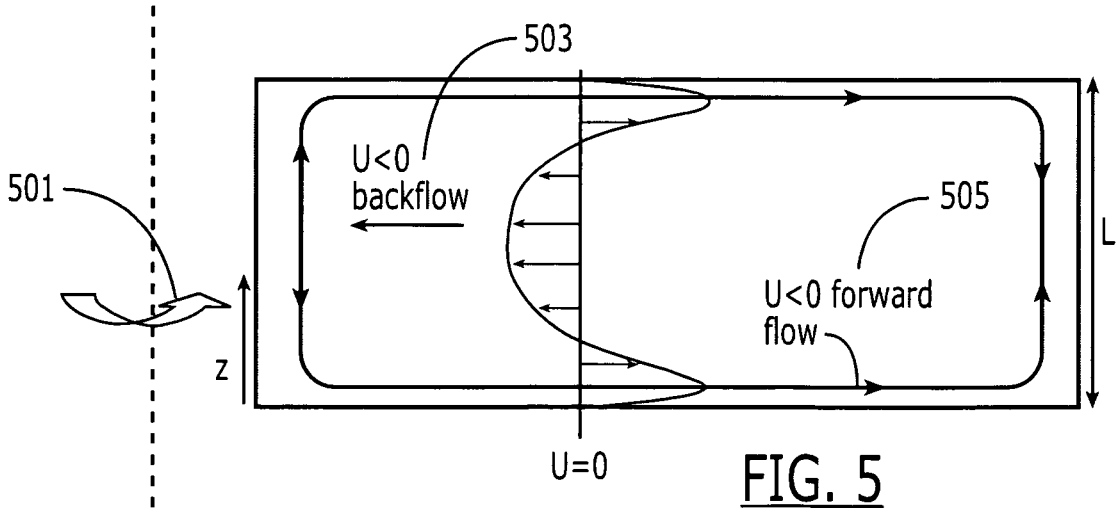
Figure 6:
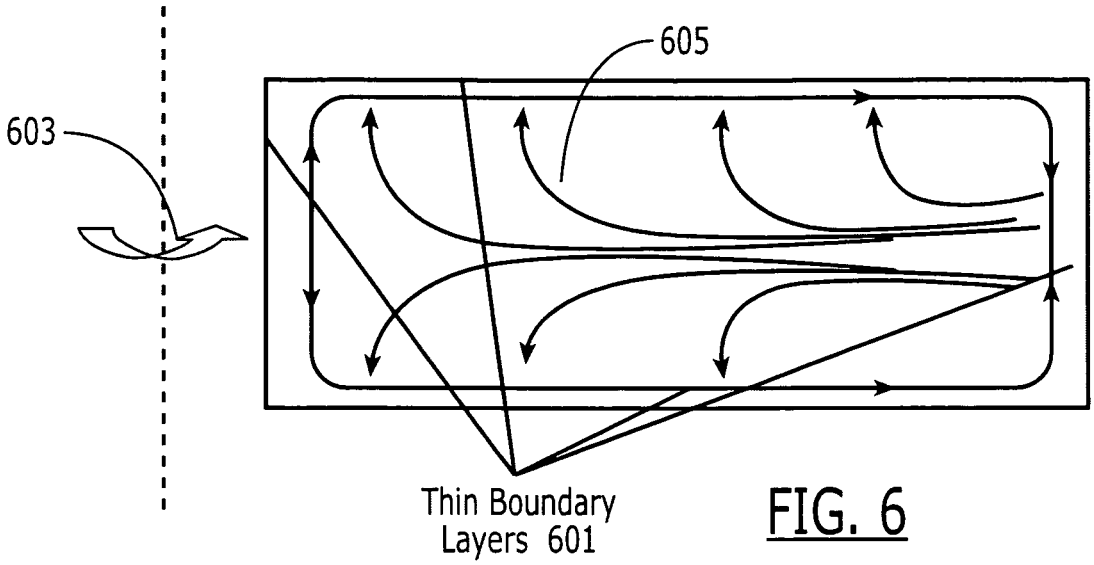

FIG. 4 exhibits acceleration and deceleration about a mean angular speed of the present rotating platform;

FIG. 5 exhibits mixing in the present invention at a low rotational speed;

FIG. 6 exhibits mixing in the present invention at a high rotational speed.

The following description of certain exemplary embodiment(s) is merely exemplary in nature and is in no way intended to limit the invention, its application, or uses. Throughout this description, the terms "diffusion", "diffused", or "diffuse" shall refer to the state or process of the spontaneous movement of particles and/or species in a solution toward a uniform concentration with another species. The term "species" can refer to a homogeneous fluid, fluid with suspended solids, liquid with dissolved solids, liquid with both dissolved solids and suspended solids, two mixable liquid mixture with one dissolved in the other, for example water dissolved in glycerine/glycerol or water in alcohol. The term "fluids" shall refer to a material or combination of materials that is liquid at room temperature and one atmosphere. The term "lab-on-a-chip" refers to capabilities for fast chemical/biological analysis of a specimen using microfluidic volumes of species. The phrase "microfluidic volume" refers to volumes equal to or less than 1000 μL.

Figure 1:
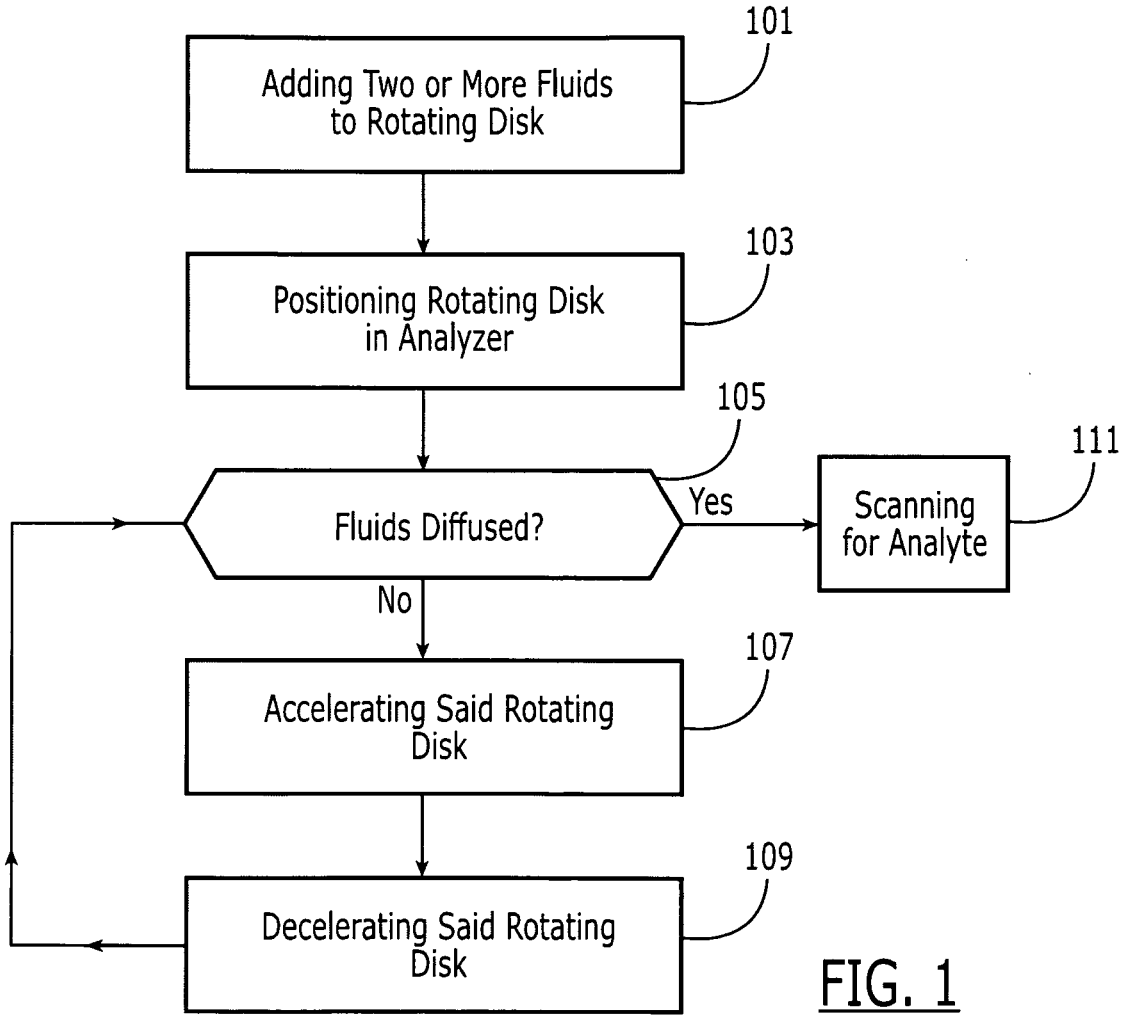
FIG. 1 shows the method of microfluidic mixing in accordance with the present invention.

Now, to FIGS. 1-6,

FIG. 1 is an embodiment of the microfluidic mixing method of the present invention, including adding species to a rotating platform, inserting the rotating disk into an analyzer, and mixing or diffusing the species.

In a first step, two or more fluids are added to the cavity in a rotating platform 101. As known in the art, microfluidic "lab-on-a-chip" environments allow the usage of microfluidic volumes of species during analysis. Species volumes can be 1-1000 μL, alternatively 1-100 μL, individually or collectively. Species can be added by methods well-known in the art, such as pipetting.

The rotating platform useful in the present method can be made of a silicone or glass substrate. The rotating platform can be from around 6 to about 13 centimeters in diameter, and from 0.1 to 1 mm in thickness. The rotating platform possesses a cavity capable of accepting the species.

In the next step, the rotating platform is positioned and placed in an analyzer 103. The analyzer can be portable or a lab-bench design. Positioning the rotating platform in the analyzer can include physically placing the rotating platform in the reader of the analyzer.

Upon being in the analyzer, a determination is made as to whether the species are at least sufficiently diffused with one another 105. Sufficient diffusion refers to the fluids not being 100% diffused into one another, but above 50% diffusion volume-to-volume. If not yet diffused, the rotating platform is then accelerated 107 and decelerated 109 to a minimum speed in a methodology allowing good mixture of the species. Maximum speed and minimum speed of the rotating platform can occur over a mean angular speed. In one embodiment, a mean angular speed of around 10 rev/min is set, with a maximum speed of 15 rev/min and minimum speed of 5 rev/min. Acceleration and deceleration can occur, for example, over a 10 minute cycle. During acceleration 107 and deceleration 109, a determination is made as to whether the species in the rotating platform's cavity have become sufficiently diffused. In the event the species become sufficiently diffused, the resultant mixture is then scanned for a desired analyte 111. If the species are not sufficiently diffused, the rotating platform is accelerated and decelerated again.

Figure 2:
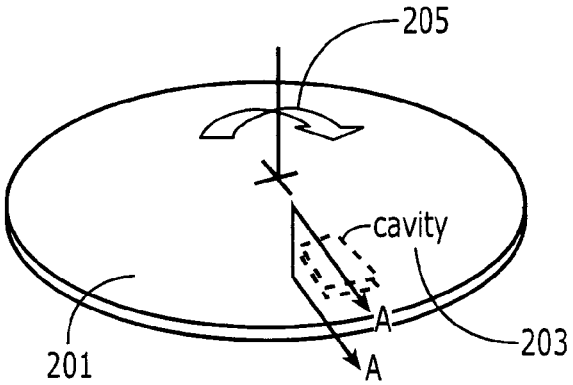
FIG. 2 is an embodiment of the rotating platform serving as the platform in the present invention.

FIG. 2 is an embodiment of a rotating platform useful in the present method. As stated, the rotating platform is preferably a silicone substrate or a glass substrate. The rotating platform 201 can be from around 6 centimeters to about 13 centimeters in diameter, and from 0.1 to 1 mm in thickness. The cavity can sized from 1 to several centimeters in diameter, and is preferably positioned near the periphery of the platform. The rotating platform 201 further includes a cavity 203 for accepting fluids for analysis. As stated, the rotating platform 201 rotates in an angular movement 205.

Figure 3:
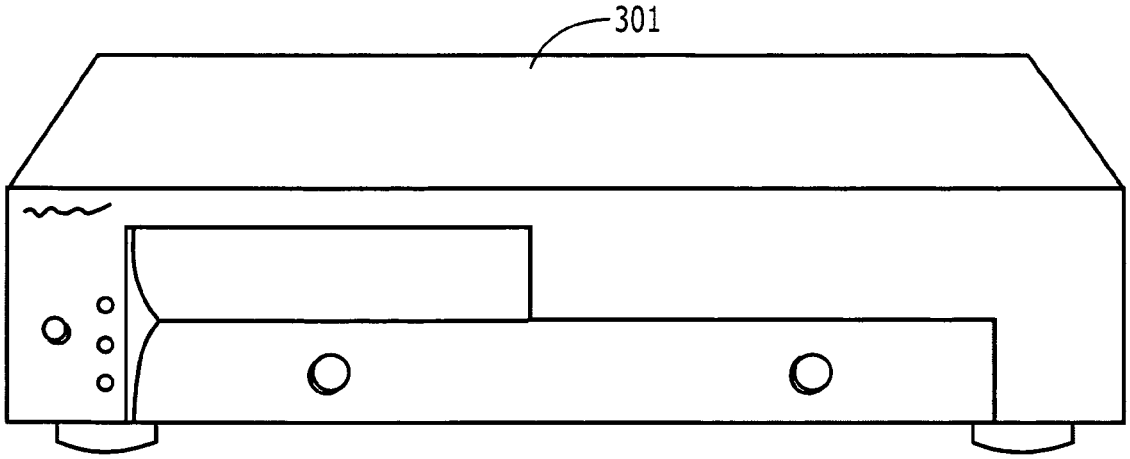
FIG. 3 is an embodiment of an optical analyzer used in the present invention.

FIG. 3 is an embodiment of a rotating platform analyzer used in the present method. As previously stated, the analyzer 301 may be portable or lab-based/stationary model. The analyzer 301 is suitable for accelerating and decelerating the rotating platform, as well as reading the diffused species for the desired analyte. The analyzer 301 produces a light beam that passes through the cavity of the rotating platform for analysis. The analyzer 301 can further includes lenses for capturing light from sources after interaction with the microfluidic solution, detectors to detect the light signal and transducer to turn the light signal into an electronic signal. The analyzer may also possess components such as a memory for recording the signal results, a processor for processing the signal, and an output means such as a display or printer.

FIG. 4 graphs continuous acceleration and deceleration of the rotating platform over time around a constant analyzer speed. The continuous acceleration and deceleration operation develops a continuous circulatory flow that mixes the fluids in the cavity. Mixing can be done at a low speed, i.e., from 1 rev/min-500 rev/min, and a low rate change in speed.

In another embodiment, intense mixing and violent agitation can be effected by circulatory flow that relies upon high rotation speed, i.e., over 1000 rev/min, and a large time rate of change in rotation speed.

FIG. 5 exhibits mixing at a low rotational speed with thick layers. Flow directions are shown during increasing angular speed 501, i.e., acceleration. The flow direction changes to the opposite direction during deceleration. This generates gentle mixing at a low rotational speed with thick layers. In this embodiment, nutrients and oxygen are brought into contact with living cells, enhancing cell growth, and protein expression. This embodiment is dominated by viscous flow.

FIG. 6 exhibits mixing at a high rotational speed. In this embodiment, flow is confined in this layers along the periphery of the flow domain in thin boundary layers 601. Flow direction during acceleration 605 and deceleration (not shown) are opposite. This embodiment generates intense mixing during periodic acceleration and deceleration.

Having described embodiments of the present system with reference to the accompanying drawings, it is to be understood that the present system is not limited to the precise embodiments, and that various changes and modifications may be effected therein by one having ordinary skill in the art without departing from the scope or spirit as defined in the appended claims.

In interpreting the appended claims, it should be understood that:

a) the word "comprising" does not exclude the presence of other elements or acts than those listed in the given claim;

b) the word "a" or "an" preceding an element does not exclude the presence of a plurality of such elements;

c) any reference signs in the claims do not limit their scope;

d) any of the disclosed devices or portions thereof may be combined together or separated into further portions unless specifically stated otherwise; and e) no specific sequence of acts or steps is intended to be required unless specifically indicated.

The invention claimed is:

1. A method of mixing different species in microfluidic-volumes of fluids, comprising the steps of:

adding at least a first and second fluids, the first fluid contains at least a first species and the second fluid contains at least a second species, in an amount of from about 1-100 μL to a cavity in a rotating platform;

rotating said rotating platform by varying the angular speed over time to generate circulatory flow, by continuous acceleration and deceleration, in said cavity for mixing said first and second species containing in said first and second fluids;

if said first and second species are not sufficient diffused, then re-rotating said rotating platform by varying the angular speed over time to generate circulatory flow, by continuous acceleration and deceleration, in said cavity for mixing the first and second species in said first and second fluids; and determining whether the first and second species are sufficiently diffused after said mixing, wherein said cavity is closed, preventing the first and second fluids from entering and leaving said cavity, while the rotating platform is rotating.

2. The method of mixing different species in microfluidic-volumes of fluids of claim 1, further comprises positioning said rotating platform in an analyzer and if said first and second species are sufficiently diffused, then analyzing the diffused species for a desired analyte.

3. The method of mixing different species in microfluidic-volumes of fluids of claim 2, wherein if said desired analyte does not reach a prescribed concentration, then re-rotating said rotating platform by varying the angular speed over time.

4. The method of mixing different species in microfluidic-volumes of fluids of claim 2, wherein if said desired analyte does not reach a prescribed concentration, then add fluid containing said species of claim 1 in an amount of from about 1-100 μL to the cavity in the rotating platform of claim 1, and re-rotating said rotating platform by varying the angular speed over time.

5. The method of mixing different species in microfluidic-volumes of fluids of claim 3, wherein if said first and second species are sufficiently diffused, then analyzing the diffused species for a desired analyte.

6. The method of mixing different species in microfluidic-volumes of fluids of claim 4, wherein if said first and second species are sufficiently diffused, then analyzing the diffused species for a desired analyte.

7. The method of mixing different species in microfluidic-volumes of fluids of claim 1, wherein said varying speed represents continuous speed change over time.

8. The method of mixing different species in microfluidic-volumes of fluids of claim 1, wherein sufficient diffusion occurs as fluid layers are bent or folded over each other due to continuous changing flow directions such that diffusion at molecular level can take place over thinner fluid layers.

9. The method of mixing different species in microfluidic-volumes of fluids of claim 1, wherein sufficient diffusion occurs when the fluids are 50% diffused volume-to-volume.

10. The method of mixing different species in microfluidic-volumes of fluids of claim 1, wherein said angular speed has a minimum speed of 1 rev/min to 500 rev/min.

11. The method of mixing different species in microfluidic-volumes of fluids of claim 1, wherein said angular speed has a maximum speed of over 1000 rev/min.

12. The method of mixing different species in microfluidic-volumes of fluids of claim 1, further comprising rotating in a direction through at least a fraction of a full rotation to generate circulatory flow for effecting sufficient diffusion during a first period without introducing an active mixing device in physical contact with the fluids.

13. The method of mixing different species in microfluidic-volumes of fluids of claim 12, wherein said direction is clockwise or counter-clockwise.

14. The method of mixing different species in microfluidic-volumes of fluids of claim 12, wherein the fluids flow through at least a fraction of a full rotation with rotation direction opposite to the rotation direction of claim 12 during a second period following the first period to generate circulatory flow without introducing an active mixing device in physical contact with the fluids.

15. A method of mixing different species in microfluidic-volumes of fluids of claim 12, wherein said fluids rotating in a clockwise direction through a clockwise rotation for one or more periods, and the same fluids rotating in an anticlockwise rotation for one or more periods, to generate circulatory flow for effecting diffusion without introducing an active mixing device in physical contact with the fluids.

* * * * *